United States Patent [19]

Jones et al.

[11] Patent Number: 4,535,898

[45] Date of Patent: Aug. 20, 1985

[54] SHELVING

[75] Inventors: Harold Jones, Stafford; David J. Bell, Telford, both of England

[73] Assignee: Link 51 Limited, England

[21] Appl. No.: 468,416

[22] Filed: Feb. 22, 1983

[30] Foreign Application Priority Data

Feb. 27, 1982 [GB] United Kingdom ..... 8205849

[51] Int. Cl.[3] ..... A47F 5/00

[52] U.S. Cl. ..... 211/153

[58] Field of Search ..... 211/153, 135; 428/124, 428/122, 126, 130; 220/73, 71; 312/257 M; 52/821, 802, 730

[56] References Cited

U.S. PATENT DOCUMENTS

| | | | |
|---|---|---|---|
| 791,155 | 5/1905 | Macdonald | 211/153 |
| 2,309,212 | 1/1943 | Reeves | 211/153 |
| 3,648,626 | 3/1972 | Schuster | 211/135 X |
| 3,986,616 | 10/1976 | Gray | 211/153 |
| 4,064,813 | 12/1977 | Hewett et al. | 211/153 X |

OTHER PUBLICATIONS

Top and Bottom Attachments for Sheet Metal Containers, Wallace C. Mills, *Product Engineering*–Aug. 1945.

*Primary Examiner*—Ramon S. Britts

*Assistant Examiner*—Sarah A. Lechok

*Attorney, Agent, or Firm*—Berman, Aisenberg & Platt

[57] ABSTRACT

The invention is concerned with a shelving structure of the kind which is assembled from a number of vertical elements (struts) and interconnected horizontal elements (beams), and in particular to a shelf for such a shelving structure. Such shelves are conventionally formed from sheet metal, comprising a horizontal shelf panel and flanges extending vertically downwardly from the shelf panel on at least two sides thereof, each flange being folded backwardly on itself to increase the strength of the flange. In accordance with this invention, each flange is so folded as to provide a pocket in which an elongate reinforcing member is positioned, such reinforcing members engaging the underside of the shelf panel. In particular, each flange comprises a first portion extending downwardly from the panel, a second portion folded inwardly so as to extend towards the underside of the shelf panel generally parallel to, and spaced from the first portion, the reinforcing member being located between said first and second portions, transmitting load from the shelf by virtue of its engagement with the underside of the shelf and transmitting such load to an intermediate portion between said first and second portions.

9 Claims, 4 Drawing Figures

SHELVING

BACKGROUND OF THE INVENTION

This invention is concerned with improvements relating to shelving, particularly of the type utilised in shelving structures of the kind (hereinafter referred to as of the kind specified), assembled from preformed components.

A typical shelving structure of the kind specified is assembled from a number of vertical elements (struts) and interconnected horizontal elements (beams) on which shelves are mounted. A shelf for such a shelving structure conventionally comprises a flat, generally rectangular shelf panel and flanges extending downwardly from the shelf panel around the four sides thereof, the flanges resting on horizontal components of the structure to provide support for the shelf.

Difficulty has been encountered in shelving structures of the kind specified in attempting to increase the strength of the shelves to enable them to be capable of supporting greater loading. For example, it has been suggested to fold an end portion of each of the flanges inwardly to lie closely against the inside face of the flange. In this manner, the tendency of the end of the flange to buckle is reduced.

Additionally, it is possible to form the shelf from metal sheet of thicker cross-section; however this adds greatly to the cost of the shelf, and it is uneconomic in that it is wasteful of metal.

A suggestion has been made, in U.K. Patent Specification No. 1,512,268 to increase the strength of the shelf by folding a portion of the flange inwardly against the inside of the downwardly extending portion, and bending the flange over so that an edge portion bears closely against a marginal portion of the underside of the shelf panel.

This suggestion, whilst providing some increase to the strength of the shelf in a manner which is more economical than simply increasing the thickness of the metal sheet, suffers from the following disadvantages:

(a) the degree of increase in strength is limited by the tendency of the folded flange to unroll;

(b) to increase the strength of the shelf further it is necessary to resort to increasing the thickness of the metal sheet from which the shelf is fabricated;

(c) the system lacks versatility.

BRIEF SUMMARY OF THE INVENTION

According to this invention, there is provided a shelf formed from metal sheet and comprising a shelf panel and flanges extending from the shelf panel on at least two sides of the panel, wherein each flange is folded so as to provide a pocket, and a reinforcing member is positioned in each pocket to engage the underside of the shelf panel.

According to this invention, there is also provided a shelf formed from sheet material and comprising a shelf panel and at least one dependent flange comprising a first portion extending downwardly from the panel, and a second portion folded inwardly so as to extend towards the underside of the shelf panel generally parallel to, and spaced from the first portion, and a reinforcing member located between said first and second portions and which extends upwardly towards, and into engagement with, the underside of the shelf panel.

Preferably the flange comprises an intermediate portion between the first and second portions, on which the reinforcing member is seated, whereby downward force transmitted from the shelf panel to the reinforcing member may in turn be transmitted to the flange.

Said intermediate portion may be flat, but is preferably curved, that is providing a part-cylindrical engagement surface facing towards the underside of the shelf panel and preferably the reinforcing member is provided with a similarly shaped engagement surface adapted to seat on said engagement surface.

Preferably therefore the reinforcing member comprises first and second portions folded one against the other with an intermediate portion interconnecting said first and second portions and providing said engagement surface of the reinforcing member.

Preferably the reinforcing member also comprises a transverse portion lying generally in a plane extending at right angles to the plane in which the first portion (and also the second portion) extends, and which engages with the underside of the shelf panel.

Particularly where the shelf panel is square, preferably such flanges and reinforcing members are provided on all four sides thereof.

However, particularly where the shelf panel is not square, such flanges and reinforcing members may be provided on only two, conveniently the longer, sides of the shelf.

By the use of separately formed reinforcing members to increase the strength of the shelf, the reinforcing members may be formed, such as of folded metal, in a separate operation from that in which the remainder of the shelf is formed, and/or may conveniently be a metal of a different thickness and/or of different physical characteristics to that which constitutes the remainder of the shelf.

Thus the thickness and/or the material of the reinforcing members may be selected to provide the required degree of strength to the shelf.

Thus if desired, particularly where the shelf is not square, reinforcing members may be provided along the two longer sides may be of greater thickness than the reinforcing members provided along the two shorter sides.

DETAILED DESCRIPTION OF THE PREFERRED EMBODIMENTS

Figure 4:
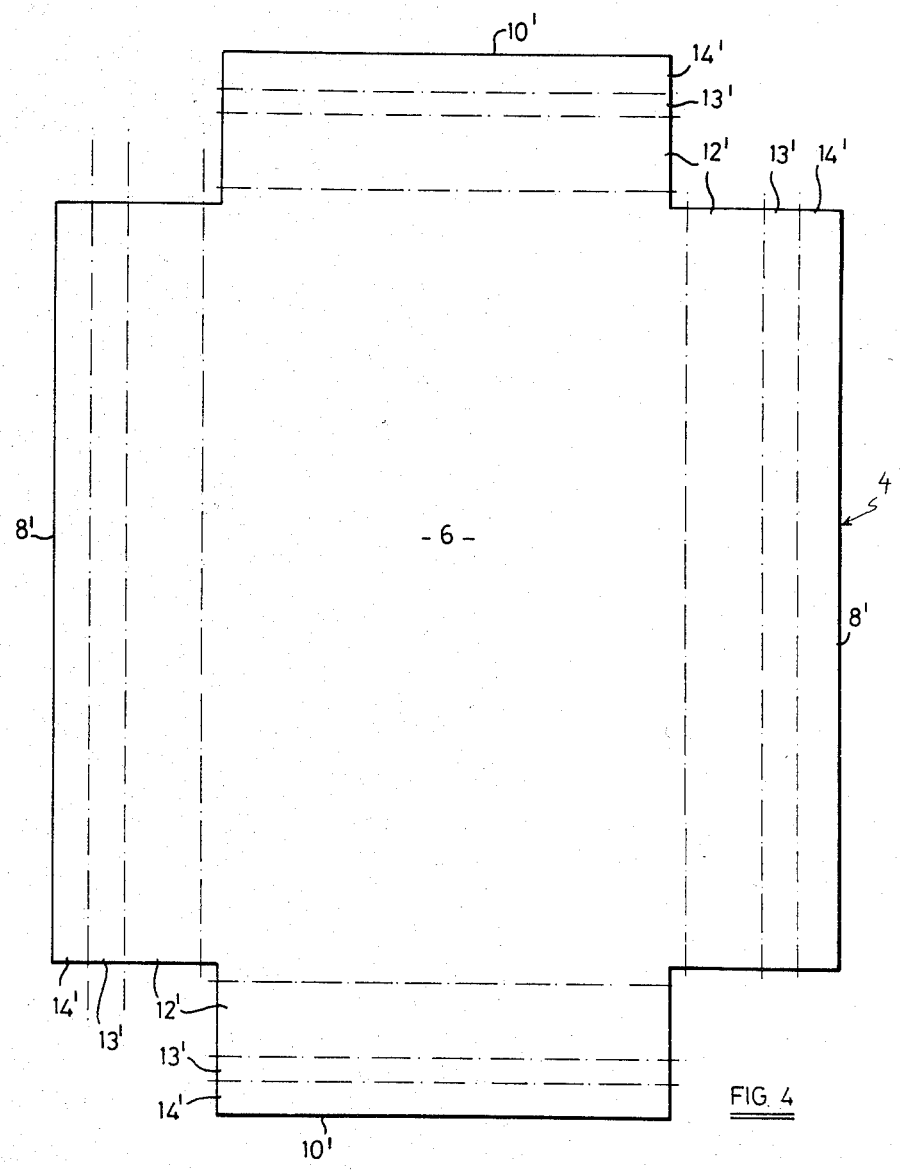
FIG. 4 is a view of a metal sheet stamping from which the shelf, but not the reinforcing members thereof, is formed by a folding operation.

In the formation of the shelf which is the preferred embodiment of this invention, a sheet 4 of metal, formed by a stamping operation, shown in FIG. 4, is utilised, the sheet providing a central area 6, constituting a shelf panel, and four flanges 8,8,10,10, the flanges 8 extending along the sides of the shelf panel of longer length and the flanges 10 extending along the sides thereof of shorter length.

The four flanges are folded to provided in each case a first portion 12 extending downwardly from the shelf panel 6, an intermediate portion 13 of generally part-circular cross-section extending from the portion 12, and a second portion 14 extending from the portion 13 generally parallel to the portion 12 towards the underside of the shelf panel. However, whilst in the case of the flanges 8,8 the portions 12 and 14 are spaced apart, in the case of the flanges 10,10 the portions 12 and 14 are in abutting relationship. In FIG. 4, the parts of the stamping which will provide said flanges and said flange portions are indicated by the same numerals with an apostrophe.

The shelf also comprises two elongate reinforcing members 16, also formed by a folding operation carried out on a sheet of stamped metal.

Each reinforcing member 16 comprises a first portion 17, one end of which extends to an intermediate portion 18, and a second portion 19 extending from the intermediate portion. The opposite end of the first portion 17 extends to a terminal portion 20.

The shape and configuration of the reinforcing member 17 is such that it may be located in an upwardly open pocket 22 defined by the portions 12,13 and 14 of the flange 8, in a manner such that the first portions 12 and 17, the intermediate portions 13 and 18, and the second portions 14 and 19 are in close fitting contact, and the terminal portion 20 engages with the underside 7 of the shelf panel.

Most conveniently, the stampings from which the reinforcing members are to be formed are positioned adjacent to the shelf 4 prior to it being folded to provide the shelf.

Figure 1:
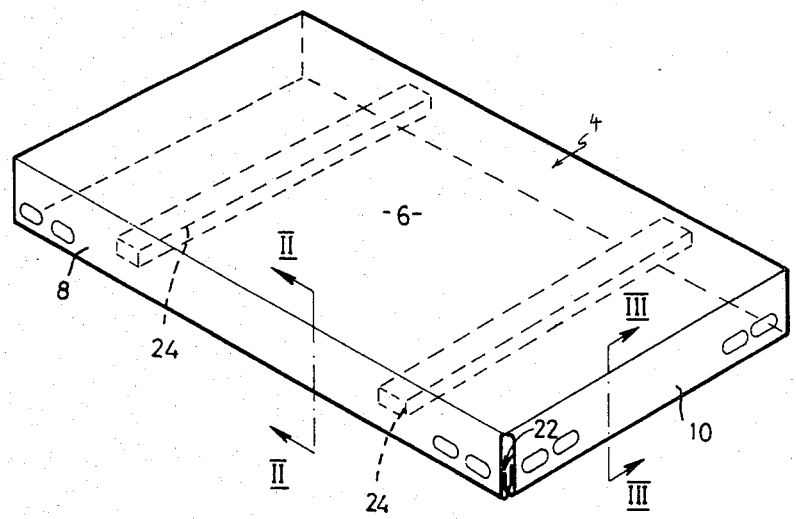
FIG. 1 is a schematic view of a shelf which is a preferred embodiment of this invention, and which has been selected for the purposes of illustrating the invention by way of example.
Figure 2:
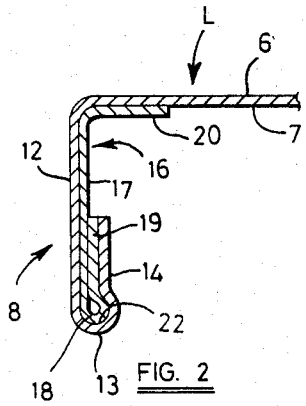
FIG. 2 is a cross-sectional view taken on the line II—II of FIG. 1.
Figure 3:
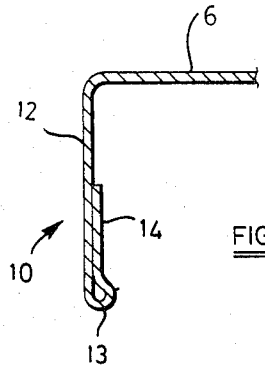
FIG. 3 is a cross-sectional view taken on the line III—III of FIG. 1.

In this manner, load (indicated L in FIG. 2) applied to the shelf panel may be transmitted to the terminal portion 20 of the reinforcing member, and applied to the flange by the inter-engagement between the intermediate portion 18 and the intermediate portion 13.

In this manner, a greater load may be applied to the shelf panel with limited tendency for the flange to buckle or unroll.

If desired, the reinforcing member 7 may be formed from sheet metal of greater thickness than that providing the remainder of the shelf, to increase the load bearing capability of the shelf.

Whereas in the preferred embodiment, reinforcing members are not provided in the flanges extending along the sides of the shelf of smaller dimension, if desired such flanges may be formed in the same manner as the flanges on the longer sides, and similar reinforcing members may be utilised to support those flanges. If necessary, the reinforcing members provided on the flanges of shorter length may be formed from metal of smaller thickness than those along the sides of longer length.

If desired, bracing struts 24 may be connected between the flanges 8 to provide additional stiffness to the shelf.

We claim:

1. In a shelf formed from sheet material and comprising a generally rectangular shelf panel and flanges integral with the panel which flanges extend from the panel along two parallel sides thereof, each flange comprising a first portion extending downwardly from the panel, a second portion folded inwardly so as to extend towards the underside of the shelf panel generally parallel to the first portion, the improvement wherein said second portion is spaced from said first portion, and on each of the said sides of the panel a non-integral reinforcing member is located between said first and second portions of the flange, which reinforcing member extends upwardly, and into engagement with, the underside of the shelf panel, an upper end of said reinforcing member extending in angular relationship to the upwardly extending portion thereof and being in juxtaposition with said underside of the shelf panel to support the corner between the panel and the first portion of the flange along substantially the whole of the length of said side.

2. A shelf according to claim 1 wherein the flange comprises an intermediate portion between the first and second portions, on which the reinforcing member is seated.

3. A shelf according to claim 2 wherein said intermediate portion is flat.

4. A shelf according to claim 2 wherein said intermediate portion is curved, providing a part-cylindrical engagement surface facing towards the underside of the shelf panel, and the reinforcing member is provided with a similarly shaped engagement surface adapted to seat on said engagement surface.

5. A shelf according to claim 4 wherein the reinforcing member comprises first and second portions folded one against the other with an intermediate portion interconnecting said first and second portions and providing said engagement surface of the reinforcing member.

6. A shelf according to claim 5 wherein the reinforcing member also comprises a transverse portion lying generally in a plane extending at right angles to the plane in which the first portion extends, and which engages with the underside of the shelf panel.

7. A shelf according to claim 1 wherein the shelf panel is square, and is provided with such flanges and reinforcing members on all four sides thereof.

8. A shelf according to claim 7 wherein reinforcing members of one thickness are provided along two of the sides of the shelf, and reinforcing members of a different thickness are provided along the other two sides of the shelf.

9. A shelf according to claim 1 wherein the reinforcing members are formed of metal of a different thickness and/or of different physical characteristics to that which constitutes the remainder of the shelf.

* * * * *